US005720245A

United States Patent [19]

Calka

[11] Patent Number: 5,720,245

[45] Date of Patent: Feb. 24, 1998

[54] FINGER FOLLOWER ARM

[75] Inventor: Andrzej Calka, Ancaster, Canada

[73] Assignee: Sandco Automotive Limited, Hamilton, Canada

[21] Appl. No.: 555,949

[22] Filed: Nov. 13, 1995

[51] Int. Cl.[6] ..... F01L 1/18

[52] U.S. Cl. ..... 123/90.41; 123/90.42; 123/90.44; 74/519; 74/559

[58] Field of Search ..... 123/90.39, 90.41, 123/90.42, 90.43, 90.44; 74/519, 559; 29/888.2

[56] References Cited

U.S. PATENT DOCUMENTS

| | | | |
|---|---|---|---|
| Re. 33,870 | 4/1992 | Fittro et al. | 123/90.41 |
| 2,905,161 | 9/1959 | Latham | 123/90.39 |
| 2,917,033 | 12/1959 | Brogren | 123/90.39 |
| 3,667,434 | 6/1972 | Sandusky | 123/90.41 |
| 4,848,180 | 7/1989 | Mills | 123/90.39 |
| 5,010,857 | 4/1991 | Hempelmann et al. | 123/90.41 |
| 5,016,582 | 5/1991 | Mills | 123/90.39 |
| 5,063,889 | 11/1991 | Pryba et al. | 123/90.41 |
| 5,259,346 | 11/1993 | Mills | 123/90.39 |
| 5,372,097 | 12/1994 | Joseph et al. | 123/90.36 |
| 5,535,641 | 7/1996 | Uchida et al. | 74/559 |

FOREIGN PATENT DOCUMENTS 0573674 12/1993 European Pat. Off. .

*Primary Examiner*—Weilun Lo
*Attorney, Agent, or Firm*—Rogers & Scott

[57] ABSTRACT

A finger follower arm is provided for mounting on a support post to transmit oscillatory motion from a cam to a poppet valve to cause the valve to move linearly between open and closed positions. The arm has a support post end including a downwardly open domed socket for engagement on the support post and an upstanding peripheral wall. A tappet valve end defines a downwardly open channel having parallel side surfaces and a downwardly facing bearing surface between the side surfaces for engagement with said poppet valve. A pair of upstanding spaced-apart side walls extend between the support post end and the tappet valve end and blend into the peripheral wall which extends continuously between the side walls to rigidify the support post end. A method of manufacture is also described.

2 Claims, 3 Drawing Sheets

FINGER FOLLOWER ARM

FIELD OF THE INVENTION

This invention relates to finger followers used to transfer rotary motion from an overhead camshaft into reciprocal motion of poppet valves used as inlet and outlet valves in an engine. More particularly, the invention relates to an improved finger follower arm for assembly with a bearing used to engage with a cam of an overhead camshaft, the arm being made by stamping a steel blank and then forging to complete the arm.

BACKGROUND OF THE INVENTION

The present invention is particularly useful in automobiles which use internal combustion engines. Manufacturers of such engines have been concentrating for some time in making them more efficient while at the same time reducing the overall weight to improve the efficiency of the automobile generally. This has focused design efforts on making inexpensive, lighter finger follower arms which nevertheless have high structural rigidity to ensure accurate performance free of harmonic vibrations caused by repeated bending loads applied to the arm.

Although attempts have been made to cast such arms from various alloys, and to make arms from ceramic materials, the preferred method of manufacture continues to be stamping to form steel blanks and then to complete using appropriate forming and machining steps. This invention is directed to arms made from steel using primarily stamping techniques with the added step of post forming the stamping.

Finger followers are initially stamped in one of two ways as illustrated by FIGS. 1 and 2 which are labelled "Prior Art".

As seen in FIG. 1, a follower arm 20 has a domed socket 22 at a support post end 24 of the arm, and a poppet valve end 26 has a U-shaped cross-section. Generally, the structure is open downwardly so that an upwardly facing aperture 28 has to be provided for a bearing (as is conventional in the art). By contrast, a finger follower 30 seen in FIG. 2 is open upwardly. Both followers have advantages which will be apparent from the following comparisons.

The follower 20 is made by first stamping the general shape of the follower. At the other end, the U-shaped cross-section is shaped to accommodate a poppet valve end located between sides of the U-shaped section. The aperture 28 is post formed by pushing a die through the arm to finish form the opening by flaring the material and defining side walls 32, 34. These walls must be smooth and relatively accurately positioned to guide the aforementioned bearing. Lastly, openings 36, 38 are finished to receive a pin on which the bearing is mounted.

The arm 20 has a number of disadvantages which are generally thought to be outweighed by the advantage that the poppet valve end 26 is both narrow and well formed to receive and locate an end of the poppet valve. The disadvantages include the difficulty of making the walls 32, 34 to the required specifications and the fact that the formation of the domed socket 22 inevitably results in a weakness in the structure between the socket and an adjacent transverse wall 40 bordering the aperture 28. To overcome this, relatively large gauge material must be used with resulting complications in stamping and forming as well as increased weight.

By contrast, the arm 30 shown in FIG. 2 has advantages where the arm 20 has disadvantages and vice versa. For instance, no opening 28 has to be formed so that the walls 42, 44 can be defined; and a domed socket 46 is contained within a peripheral wall which gives great rigidity. However, although the poppet valve end 48 is narrow, it has no guide for the poppet valve. Consequently a disadvantage of this arm is that the arm relies entirely on alignment of parts and resistance to misalignment to keep the poppet valve and arm in the required relationship. This is undesirable because repeated loading will inevitably result in wear and gradual exacerbation of the problem.

It will be evident that a finger follower arm which has the advantages of both types of arms shown in FIGS. 1 and 2 would be beneficial.

SUMMARY OF THE INVENTION

A finger follower arm is provided for use with a bearing to form a finger follower of the type which in use is mounted on a support post to transmit oscillatory motion from a cam to a poppet valve to cause the valve to move linearly between open and dosed positions. According to one aspect of the invention the arm has a support post end including a downwardly open domed socket for engagement on the support post and an upstanding peripheral wall. A tappet valve end defines a downwardly open channel having parallel side surfaces and a downwardly facing bearing surface between the side surfaces for engagement with the poppet valve. A pair of upstanding spaced-apart side walls extend between the support post end and the tappet valve end and blend into the peripheral wall which extends continuously between the side walls to rigidify the support post end.

In another of its aspects the invention includes a method of making an arm including the step of forming a poppet valve end having a W-shaped cross-section.

DESCRIPTION OF THE PREFERRED EMBODIMENTS

Figure 1:
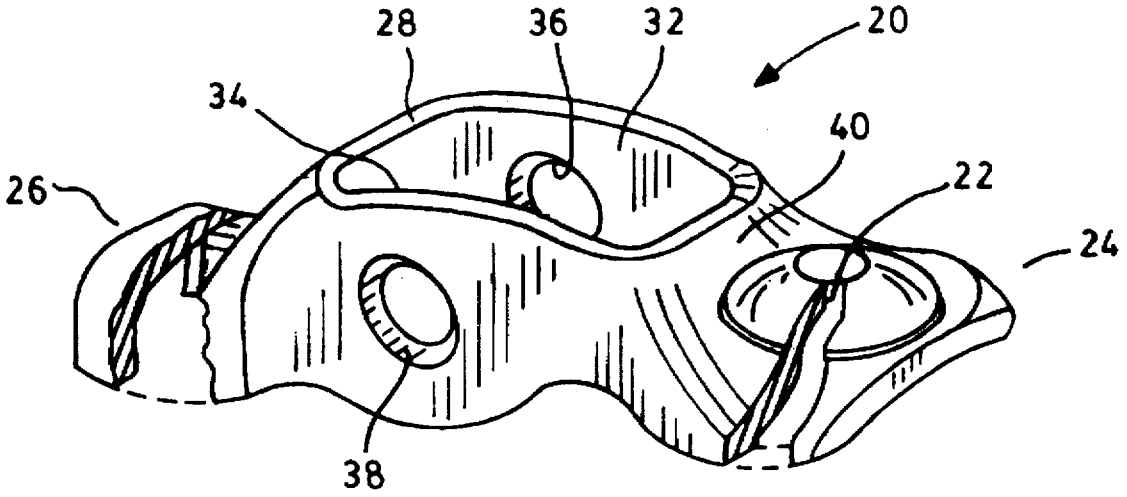
FIGS. 1 and 2 show prior art finger follower arms.
Figure 2:
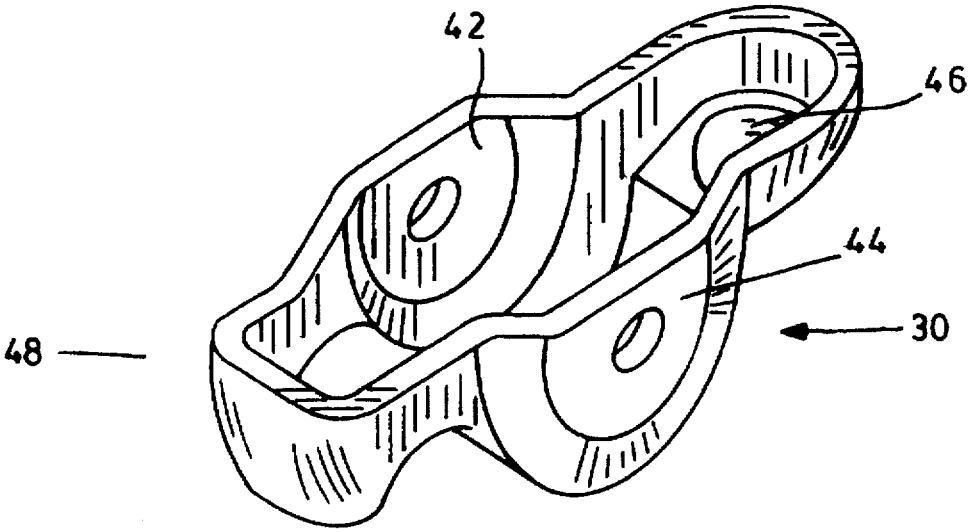

As previously discussed, FIGS. 1 and 2 show exemplary prior art finger follower arms which illustrate the advantages and disadvantages of prior art structures. The remainder of the FIGS. illustrate aspects of the present invention.

Figure 3:
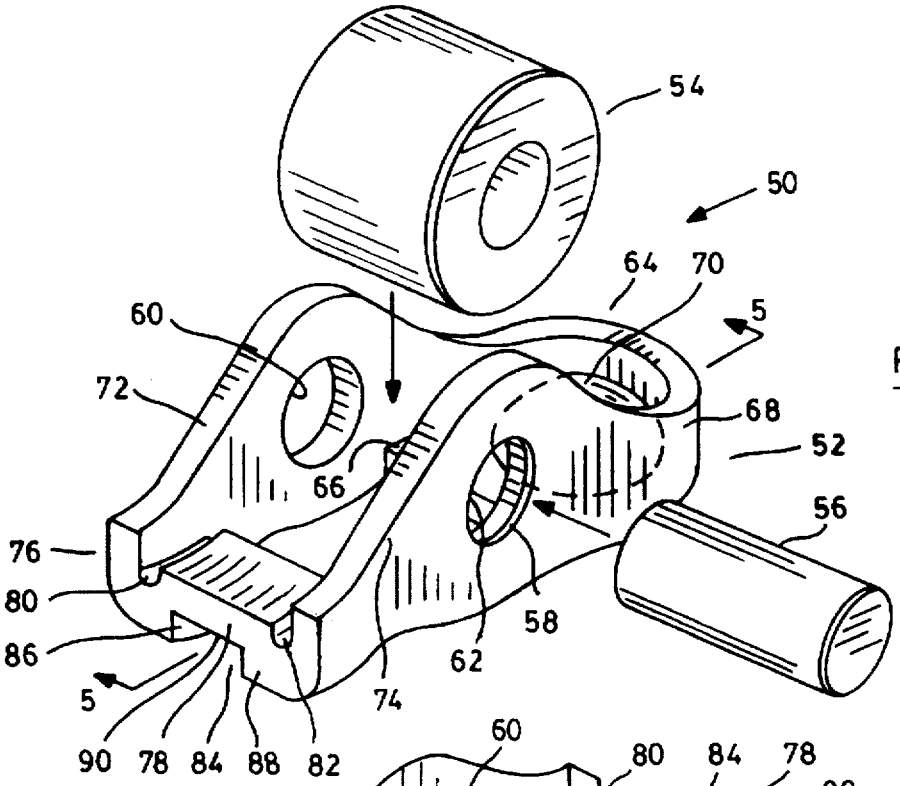
FIG. 3 is an exploded isometric view from the top and one side of a preferred embodiment of finger follower arm in accordance with the invention and shown with parts of a bearing to be assembled in the arm to complete a finger follower.

Reference is now made to FIG. 3 which illustrates a finger follower arm indicated generally by the numeral 50.

The finger follower 50 includes an arm 52 and a bearing 54 (shown diagrammatically) which, on assembly, includes a pin 56 held in place by staking ends of the pin into a chamfer 58 (one of which can be seen) around openings 60, 62 in the arm 52. Such bearings are conventional in the art.

The arm 52 includes a support post end 64 having a partial floor 66 from which extends an upstanding peripheral wall 68 which extends about a downwardly opening domed socket 70 positioned so that the floor 66 connects the socket to the peripheral wall 68. This wall blends smoothly into a pair of spaced-apart and parallel upstanding side walls 72, 74 which define the respective openings 60, 62 for the pin 56.

The side walls 72, 74 terminate at a tappet valve end 76 which has a generally W-shaped cross-section including a bridge piece 78 including at its ends a pair of U-shaped parallel grooves 80, 82 located adjacent ends of the side walls 72, 74.

Figure 4:
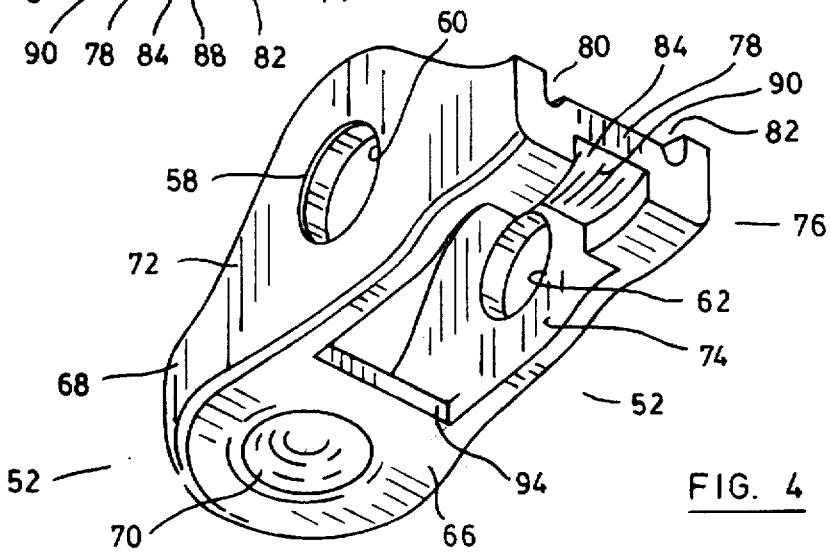
FIG. 4 is an isometric view from the bottom of the other side of the finger follower arm.
Figure 5:
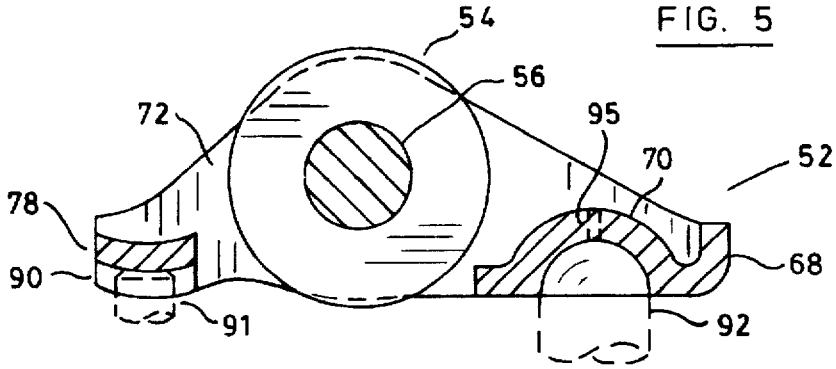
FIG. 5 is a sectional side view on line 5—5 of FIG. 3 with the finger follower assembled and showing in ghost outline parts of a support post and a poppet valve.

The tappet valve end 76 also defines a downwardly opening channel 84 extending longitudinally of the arm 52 from an outer extremity of this end and defined by side surfaces 86, 88 and a downwardly facing bearing surface 90. As can be seen in FIGS. 4 and 5, the surface 90 is downwardly convex to maintain sliding contact with the upper end of a poppet valve 91 (seen in ghost outline) as the finger follower moves angularly about the end 64 which is supported on a post 92, (also seen in ghost outline in FIG. 5). The upper end of the post 92 is hemispherical as is the corresponding shape of the domed socket 70 to provide angular sliding movement between these parts.

As will be described, the arm 52 is formed initially with a generally U-shaped section at the tappet valve end 76 and the end is completed by a second step to be described with reference to FIGS. 6 and 7 to complete the W-shaped cross-section of this end.

Details of the underside of the arm 52 can be seen in FIG. 4. It will be clear in this view that the domed socket 70 is formed in effect from the partial floor 66. This floor combines with the side walls 72, 74 and the bridge piece 78 to define a rectangular opening 94. This opening both provides space for the bearing 54 and frees the bridge piece 78 for deformation into the W-shaped section as will be explained with reference to FIGS. 6 and 7. The opening can also be seen in FIG. 5 which is a sectional view on line 5—5 of FIG. 1. This view also illustrates in ghost outline an optional oil opening 95.

Figure 6:
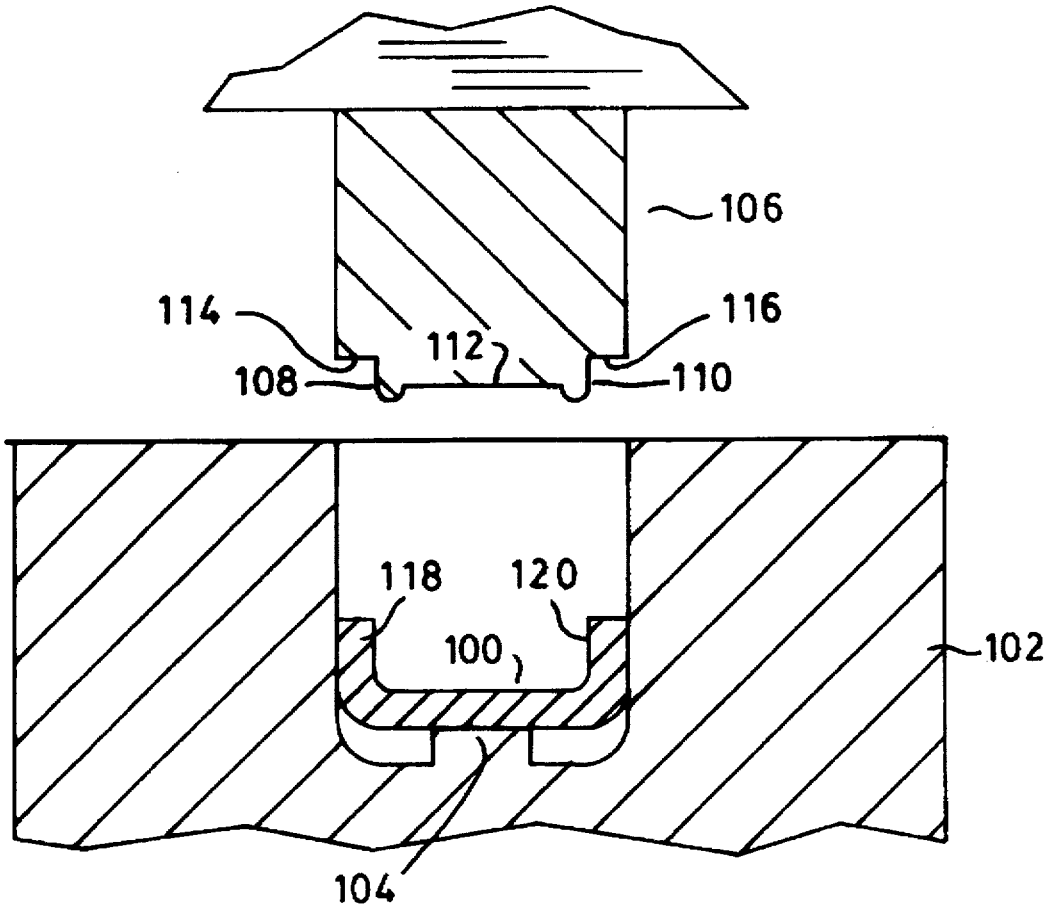
FIGS. 6 and 7 are diagrammatic views illustrating one of the steps used to make the finger follower arm.
Figure 7:
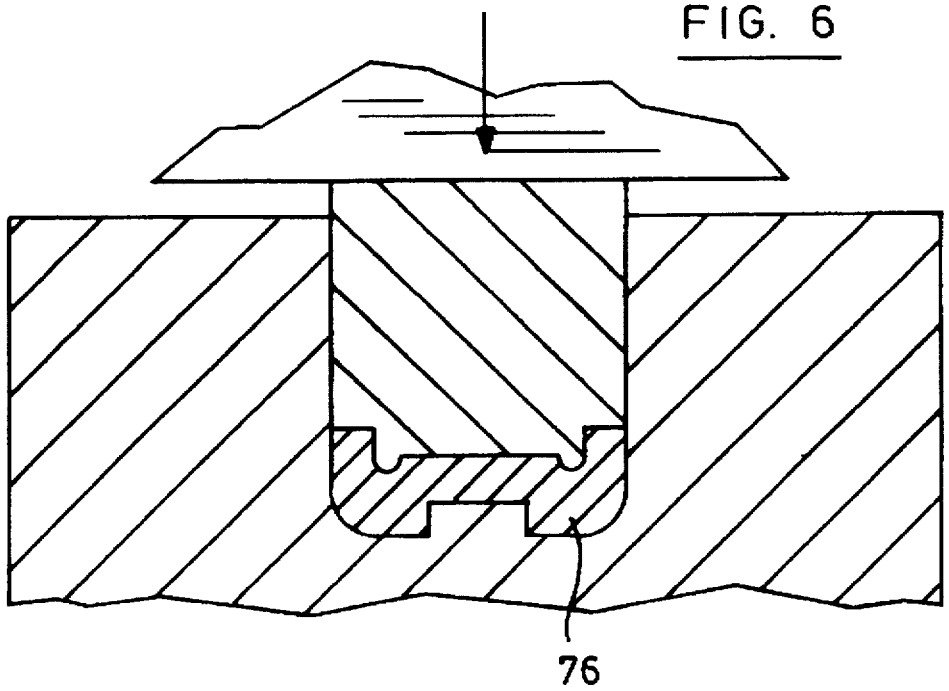

Reference is next made to FIG. 6 to illustrate the forming step used to complete the shape of the tappet valve end in 76 (FIG. 3) which starts as a U-shaped section illustrated at 100 in FIG. 6 and ends as a W-shaped cross-section previously seen in FIG. 3 and illustrated also in FIG. 7.

The U-shaped section 100 is positioned in a lower die 102 which is shaped to accommodate the width of the arm and includes an upstanding ridge 104 which is the complementary shape of the channel 84 seen in FIGS. 3 and 4. An upper die 106 has a projecting lower surface including a pair of spaced-apart ribs 108, 110 separated by a central surface 112. The ribs and central surface complement the upper features of the bridge piece 78 including the grooves 80, 82 seen in FIG. 3. The upper die 106 also incorporates a pair of shoulders 114, 116 proportioned to engage upright wall portions 118, 120 of the arm as the upper die is closed with the lower die in the manner illustrated in FIG. 7. As these dies come together under load, metal flow takes place to transfer material from the U-shaped section shown in FIG. 6 into the W-shaped section shown in FIG. 7. To enhance this flow, the U-shaped section is effectively separated from the major parts of the arm by the rectangular opening 94 which defines the limit of the material to be effected by the dies coming together. It will be evident from a comparison of FIG. 6 and 7 that the dies will create the W-shaped tappet valve end 76 using normal forging and metal flow techniques and that the channel 84 (FIG. 1) is narrower than the extent of the bridge piece between the grooves 80, 82.

It will be evident to a person skilled in the art that various shapes of finger follower arm can be made within the scope of the invention, and such shapes are included within the scope of the claims.

I claim:

1. A one-piece steel finger follower arm cold formed from sheet steel and comprising:

a pair of spaced-apart upstanding parallel side walls defining aligned openings to mount a bearing;

a support shaft end attached to the side walls and including a downwardly opening domed socket for engagement on a support post, and an upstanding peripheral wall extending continuously from the side walls about the domed socket;

a poppet valve end having a W-shaped cross-section, attached to the side walls and including a bridge piece having a downwardly opening channel of less width than the spacing between the side walls for engagement on a poppet valve and defining upwardly opening generally U-shaped grooves adjacent the respective side walls the grooves being positioned above and to either side of the downwardly opening channel;

the side walls, the support shaft end, and the poppet valve end combining to define an opening providing clearance to accommodate said bearing between the side walls; and the channel and the grooves extending from said opening to the extremity of the poppet valve end.

2. A steel finger follower arm as claimed in claim 1 in which the support shaft end further includes a partial floor bordering said aperture and extending between the domed socket and the peripheral wall.

* * * * *